United States Patent [19]

Bloom et al.

[11] 4,408,407

[45] Oct. 11, 1983

[54] PANEL SIGN

[75] Inventors: Hanley D. Bloom, Los Angeles; Stanley Bloom, Beverly Hills; Fred E. Perry, Pomona; Sam Leone, Canoga Park, all of Calif.

[73] Assignee: Architectural Signing, Inc., Marina Del Rey, Calif.

[21] Appl. No.: 385,281

[22] Filed: Jun. 4, 1982

[51] Int. Cl.[3] ..... G09F 15/00

[52] U.S. Cl. ..... 40/607

[58] Field of Search ..... 40/605, 606, 607

[56] References Cited

U.S. PATENT DOCUMENTS

| | | | |
|---|---|---|---|
| 4,068,398 | 1/1978 | Parisi | 40/607 |
| 4,237,636 | 12/1980 | Mathews | 40/606 |
| 4,276,706 | 7/1981 | Scott | 40/607 |
| 4,334,374 | 6/1982 | Spamer et al. | 40/606 |

*Primary Examiner*—Gene Mancene
*Assistant Examiner*—Wenceslao J. Contreras
*Attorney, Agent, or Firm*—Ralph B. Pastoriza

[57] ABSTRACT

The panel sign includes one post in the case of a "flag" type sign and two posts for a panel sign supported at opposite ends, together with a generally rectangular panel member. Each post constitutes an extruded member having an elongated vertical slot communicating with a hollow interior. The panel has an edge flange of T-shape receivable in the slot for lateral support by the post. An extruded filler element in turn has a forward portion arranged to fill the slot when the element is inserted in the hollow interior of the post. This element is cut to a length corresponding to the position of the lower end of the panel edge flange and the bottom of the post so that when inserted in the post, it serves to finish off the appearance of the post; that is, it renders the remaining slot portions substantially invisible. A small additional filler element is receivable in the top portion of the post to fill a top exposed portion of the slot where the edge flange of the panel falls below the top of the post.

6 Claims, 4 Drawing Figures

PANEL SIGN

FIELD OF THE INVENTION

This invention relates generally to signs and more particularly to panel type signs wherein the panel can be removed from its supports and the panel containing a new sign substituted therefor.

BACKGROUND OF THE INVENTION

Panel signs of the type under consideration can be used either indoors or outdoors. Generally, these signs include either a single post for supporting a generally rectangular shaped panel from one edge so as to present the appearance of a "flag" or two posts supporting opposite edges of the rectangular panel. In both constructions, the panel can be removed from the post or both posts as the case may be, for reworking of the sign on the panel or substitution of another panel containing another sign. The posts themselves are normally anchored to a floor by appropriate floor flanges or may actually be embedded in concrete so that normally they would remain in a permanent location.

To permit removal of the sign, various post constructions as presently available have been extruded members, the same being provided with an elongated slot. This slot is dimensioned to receive an interfitting portion on an edge of the rectangular panel in such a manner that the panel can be slid in or out of the post slot from the top. The slot itself normally extends the length of the post since the entire structure is extruded and thus there is an exposed slot portion along that portion of the post not occupied by the interfitting element on the panel.

The above-described structures while functioning to support the panel suffer the disadvantage of having an exposed slot along one or both posts where two posts are used. Not only does the slot mar the aesthetics of the sign, but in outdoor use the interior of the posts are exposed to the elements.

BRIEF DESCRIPTION OF THE PRESENT INVENTION

With the foregoing in mind, the present invention contemplates an improved panel sign of the type wherein the panel itself can easily be removed from a single post or dual posts and replaced, but wherein there is no exposed slot to mar the aesthetics of the sign and as a consequence, there are not presented weathering problems for outdoor signs.

More particularly, the panel sign of this invention in its broadest aspect comprises in combination at least one post having a longitudinal slot. A panel has an edge flange receivable in this slot for lateral support of the panel. A filler, in turn, is receivable in the slot and is of shorter length than the length of the post to fill the portion of the slot not occupied by the edge flange of the panel. This filler not only serves as a vertical support for the under corner of the panel but because it fills the remaining slot portion, the desired improved aesthetic appearance of the sign results and weather elements are kept out from the interior of the post.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
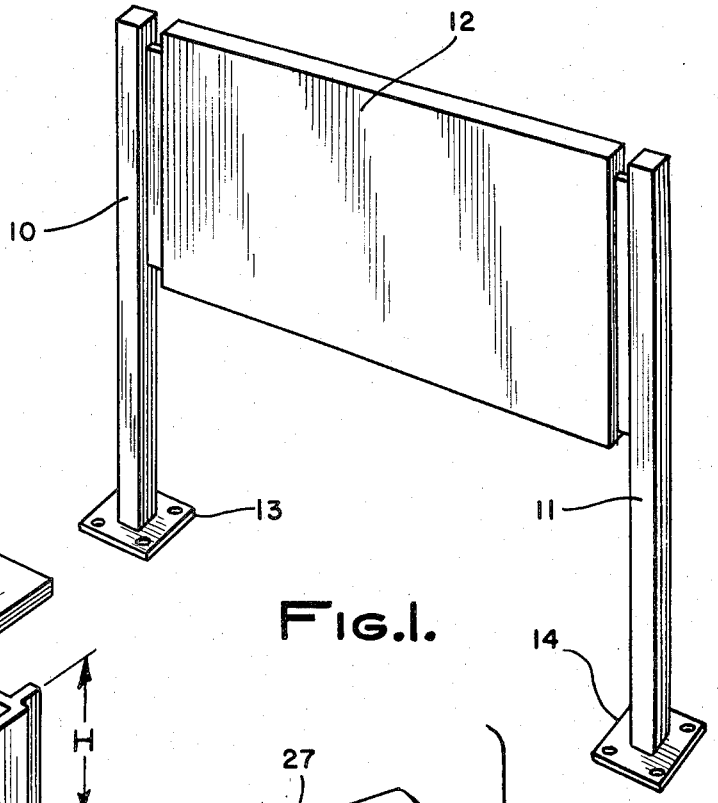
FIG. 1 is a perspective view of one type of panel sign in accord with the present invention.

Referring first to FIG. 1, the panel sign illustrated includes posts 10 and 11 for supporting opposite edges of a rectangular shaped panel 12. Panel 12 would normally contain a desired sign and in the event the sign is to be changed the entire panel 12 is removed from the posts 10 and 11.

While te sign is normally an outdoor installation, it can be used indoors as well.

In some instances, the lower ends of the posts 10 and 11 may be permanently embedded in concrete. In other applications these posts can terminate in floor flanges such as indicated at 13 and 14.

In many instances, the rectangular panel 12 can be supported with only a single post such as the post 10 so that the sign appears as a "flag" type sign. Under such circumstances, the lower end of the single post would, of course, be thoroughly secured in order to absorb the forces resulting from the cantilevering action.

The posts 10 and 11 in FIG. 1 are identical in constructional detail, as are the opposite edges of the rectangular panel 12. A detailed description of one post in its cooperation with one edge of the panel will thus suffice for both.

Figure 2:
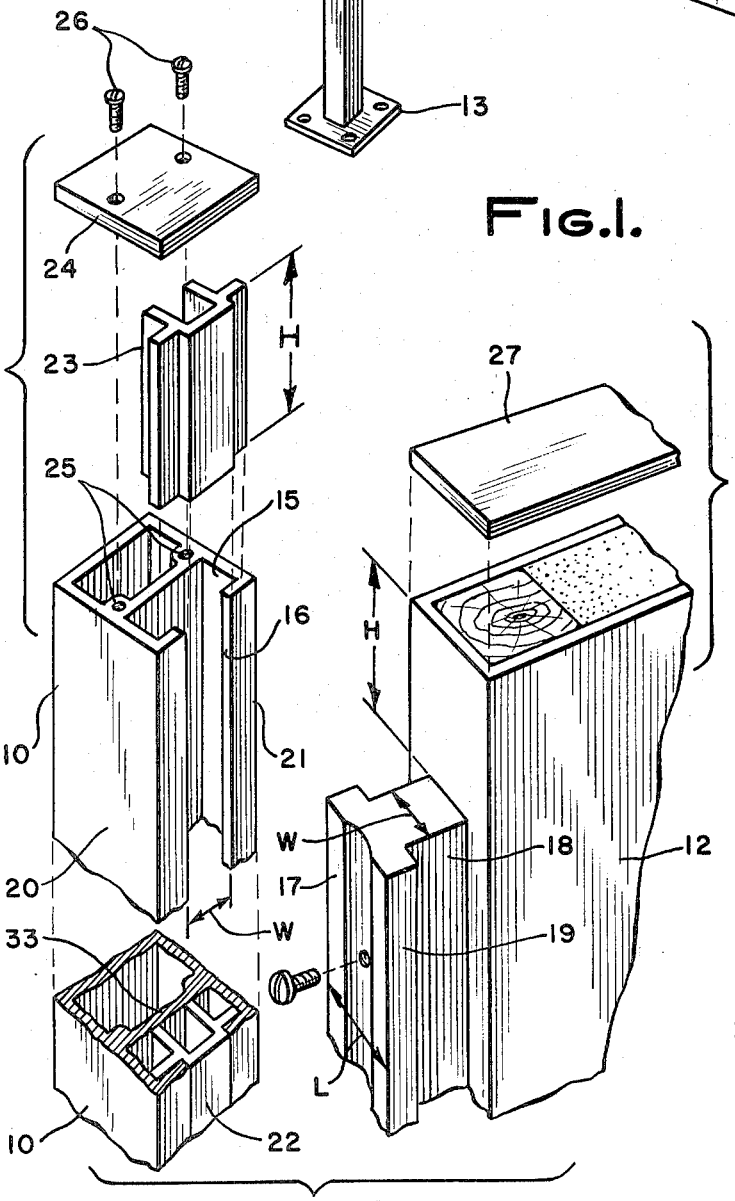
FIG. 2 is an enlarged fragmentary exploded view of component parts of the sign of FIG. 1 useful in explaining the invention.

Referring to FIG. 2, the post 10 of FIG. 1 is illustrated in broken away, exploded perspective view. Thus, the post 10 itself comprises an extruded member having a hollow interior 15 with one side having an elongated slot 16. Slot 16 has a width W as indicated.

Shown to the right of the portion of the post 10 of FIG. 2 is a fragmentary part of the panel 12 wherein there is shown an edge flange 17 of general T-shape in cross section secured to the edge of the panel 12. The width of the stem 18 of the T-shape corresponds to the width W of the slot 16 for the post, this dimension W also being indicated on the stem 18. The length of the cross portion 19 of the T shape, in turn, corresponds to the interior distance between the opposite post side walls 20 and 21 for the post 10 connecting to the wall containing the slot 16. This length is indicated at L.

With the foregoing dimensioning, it will be evident that the T-shaped edge flange 17 can be received in the interior portion 15 and slot 16 of the post 10 by simply sliding the same inwardly from the top of the post. When so interconnected, there will be provided by the post lateral support for the panel 12.

Still referring to FIG. 2, there is shown in the lower portion an elongated extruded filler element 22 receivable in the hollow interior of the post, this element having a cross-sectional design such that the slot 16 is essentially filled by part of the extruded filler element so as to provide a finished appearance. This cross-sectional shape will be described in detail subsequently.

In FIG. 2, the extruded filler element 22 would be cut to correspond to the length of the post as measured from the underside of the edge flange 17 for the panel 12 in FIG. 1 to the lower end of the post. It would then be slid in to the hollow interior portion 15 of the post 10 from the top and thereafter, the T-shaped edge flange 17 on the edge of the panel would be slid in from the top to seat on the top of the extruded element 22. Thus, the extruded element will provide vertical support for the one end of the panel associated with the edge flange 17.

It will be noted for the panel in FIG. 2 that the top of the panel 12 extends a short distance above the edge flange 17, this distance being designated by the letter H. In other words, and as is clear from the perspective view of FIG. 1, the length of the edge flange is less than the remaining room in the post 10 for receiving the same so that the post itself extends a slight distance higher than the edge flange. In this respect, the top of the post will register or be on the same level as the top of the sign.

In order to fill the slot 16 portion between the end of the edge flange 17 and the top of the post, there is accordingly provided an insert filler shown at 23 in FIG. 2 of the same cross-section as the extruded filler element 22 shown in the lower portion of FIG. 2, received within the hollow interior of the post 10. This insert filler 23 thus has a length H corresponding to the short distance or given distance designated by the same letter H that the panel sign extends above the edge flange 17.

Finally, the assembly in the preferred embodiment described in FIG. 2 is completed by the provision of a flat cover 24 which is arranged to overlie the top of the post to provide a flat finished appearance to the top and avoid exposure of the interior of the post to the weather elements. In FIG. 2, it will be noted that the extruded post includes at its upper portion two tapped openings 25 disposed adjacent to the opposite post walls 20 and 21. These tapped openings extend only a short distance and are arranged to register wth appropriate openings in the cover plate 24. Appropriate screws 26 can then be passed through the openings in the cover plate and threaded into the tapped bores 25 to secure the cover 24 in place.

From the description of the sign thus far, it will be evident that the entire panel 12 can easily be removed by simply removing the screws 26, the top plate 24, and the insert filler 23. The sign panel 12 is then slid upwardly from between the posts shown in FIG. 1 and a new sign or substitute sign inserted. The filler 23 and top cover 24 are then simply replaced.

In FIG. 2 there is shown a top covering 27 for the top of the panel 12. Typically this panel will have a wooden frame between plastic sheets, the hollow interior being filled with a foam. These components would be protected by the outer edge facing, such as the covering 27.

Figure 3:
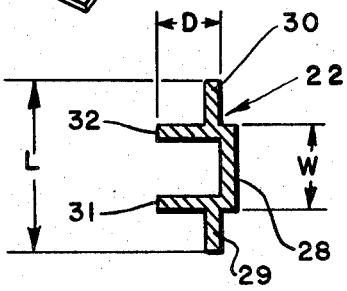
FIG. 3 is a cross section of an extruded element in accord with the present invention.

Referring now to FIG. 3, further details of the extruded filler element 22 described in FIG. 2 will be evident. As shown, the cross section of the extruded element 22 includes a forward portion 28 of width W corresponding to the width of the slot 16 described in FIG. 2. An intermediate portion in turn defines oppositely extending arms 29 and 30 for engaging the interior walls of the post sides 20 and 21 described in FIG. 2. The arms 29 and 30 extend rearwardly of the forward portion 28 by a distance corresponding to the thickness of the extruded post 10 defining the depth of the slot 16 so that the forward portion 28 will neatly fill the slot as shown in the lower portion of FIG. 2. Referring back to FIG. 3, the rear portion of the extruded element defines a pair of legs 31 and 32 extending rearwardly to engage an interior rear wall of the post opposite the slot 16. This rear wall is shown at 33 in FIG. 2 and actually in the specific embodiment set forth, constitutes a partition. As shown in FIG. 3, the rearward extent of the legs 31 and 32 from the front surfaces of the arms 29 and 30 is designated D and corresponds to the distance between the slot and the rear wall partition 33.

Figure 4:
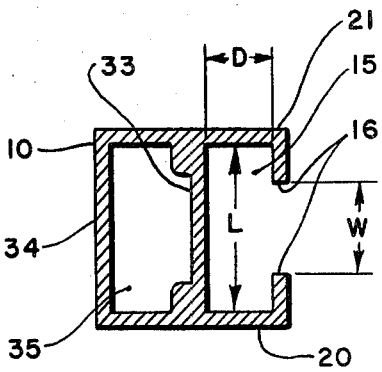
FIG. 4 is a cross section of one of the posts for the sign illustrated in FIG. 1.

All of the foregoing will become clearer by now referring to the detailed cross section of the post 10 of FIG. 2 as illustrated in FIG. 4. Thus, the slot 16 is shown as having the corresponding width W to the front portion 28 of the extruded element 22, while the distance L between the interior of the opposite post walls 20 and 21 corresponds to the distance between the ends of the oppositely extending arms 29 and 30 of the extruded element. Finally, as indicated in FIG. 4, the distance D between the front wall containing the slot 16 and the rear partition 33 corresponds to the extent of the rear legs 31 and 32 as described heretofore.

When the extruded filler element 22 is thus inserted within the channel 15 of the post, it will be securely held against any rotational or lateral movement and the slot 16 itself will be completely filled by the forward portion to provide the heretofore referred to increased aesthetic appearance of the post as well as providing a barrier against weather.

From FIG. 4, it will be noted that the opposite post walls 20 and 21 extend further rearwardly to terminate in an outside rear wall 34, spaced from the partition 33. There is thus defined a further hollow interior portion 35 in the particular embodiment disclosed. The dimensioning is such as to provide an outside perimeter for the cross section of the post corresponding to a square. By utilizing the forward portion of the post; that is, the hollow interior portion 15 described in FIG. 2 and shown in FIG. 4 for receiving the extruded filler element 22, substantial material saving is accomplished insofar as the filler itself is concerned. Also, the rectangular hollow interior resulting from the use of the partition to define the receiving interior portion for the filler provides for greater lateral stability; that is, stability against rotational movements of the extruded element within the post.

From all of the foregoing, it can now be appreciated that the present invention has provided a greatly improved panel sign. The extruded filler elements not only serve as vertical supports, but provide a fininshed appearance and protect the interiors of the posts from weather when the sign is used outdoors.

We claim:

1. A panel sign including, in combination:

(a) at least one extruded post having a hollow interior with one side having an elongated slot communicating with said interior;

(b) a panel having an edge flange of general T-shape in cross section, the width of the stem of said T-shape corresponding to the width of said slot and the length of the cross of the T corresponding to the interior distance between the opposite post side walls connecting to the wall containing said slot so that said edge flange can be received in said slot to provide lateral support for said panel; and (c) an elongated extruded filler element receivable in the hollow interior of said post, said element having a cross section comprised of a forward portion of width corresponding to said slot, an intermediate portion defining oppositely extending arms for engaging the interior of said opposite post side walls and a rear portion defining a pair of legs extending rearwardly to engage an interior rear wall of the post opposite the wall containing said slot, said forward portioon filling said slot to provide an exterior finshed appearance to said post along the length of the post within which the extruded element is received, said extruded element having a length less than the length of the post so that after being received in the post, there remains room for the post to receive said edge flange of said panel, the lower end of said edge flange seating on said extruded element to provide vertical support for one end of said panel.

2. A panel sign according to claim 1, including an additional extruded post of the same construction as said first mentioned post, said panel having an edge flange of T shape on its edge opposite the first mentioned edge for said first mentioned edge flange for a sliding movement into the interior of said additional post and an additional elongated extruded filler element receivable in said additional post to provide a finished appearance and provide vertical support for the opposite end of said panel.

3. A panel sign according to claim 1, in which the length of said edge flange is less than the remaining room in said post for receiving the same so that the post extends a given distance higher than the edge flange after the edge flange is seated on said extruded element; an insert filler of the same cross-section as said extruded element and a length corresponding to said given distance received in the top of the post to provide a finished appearance; and a flat cover overlying the top of the post to provide a flat finished appearance to the top.

4. A panel sign according to claim 3, in which the interior top of said post includes means defining tapped bores at spaced positions adjacent the interior of said opposite post walls, said cover having openings for registration with said bores when said cover is in place on top of said post; and screws receivable through said openings and into said tapped bores for securing said cover to the top of said post.

5. A panel sign according to claim 1, in which said rear wall opposite said wall containing said slot constitutes a partition, said opposite post walls extending further rearwardly and terminating in an outside rear wall for said post to define a rectangular shaped hollow portion to the rear of said partition, said rectangular interior being dimensioned such that the overall outside periphery of the cross section of said post is a square.

6. A panel according to claim 2, in which said first mentioned post and additional post terminate at their lower ends in support flanges for securement to a floor.

* * * * *